United States Patent [19]

Kurosawa

[11] Patent Number: 4,671,779

[45] Date of Patent: Jun. 9, 1987

[54] RUNNING TOY

[75] Inventor: Kenzo Kurosawa, Tokyo, Japan

[73] Assignee: Kabushiki Kaisha Gakushu Kenkyusha, Tokyo, Japan

[21] Appl. No.: 772,938

[22] Filed: Sep. 5, 1985

[30] Foreign Application Priority Data

Sep. 7, 1984 [JP] Japan ..... 59-135915[U]
Feb. 4, 1985 [JP] Japan ..... 60-14967[U]

[51] Int. Cl.[4] ..... A63H 29/22; A63H 11/12

[52] U.S. Cl. ..... 446/457; 446/278; 446/368

[58] Field of Search ..... 446/278, 269, 273, 274, 446/289, 458, 457, 431, 437, 442, 443, 462, 487, 368

[56] References Cited

U.S. PATENT DOCUMENTS 503,387 8/1893 Schofield ..... 446/487 X
2,596,216 5/1952 Dawson ..... 446/278
3,456,381 7/1969 Kinberg ..... 446/278

*Primary Examiner*—Mickey Yu
*Attorney, Agent, or Firm*—Lowe, Price, LeBlanc, Becker & Shur

[57] ABSTRACT

A running toy includes a rotatable drum, a drive shaft rotatable through a reverse mechanism by a driver assembly housed in the rotatable drum and having an end projecting out of the rotatable drum and supporting a drive gear on the projecting end, a support by which the axially opposite ends of the rotatable drum are rotatably supported and substantially covering the axially opposite ends of the drum, a guide gear fixed to the support and held in mesh with the drive gear for guiding the drive gear to revolve around the guide gear to rotate the rotatable drum in response to rotation of the drive gear, a shell assembly openably covering the cylindrical body of the rotatable drum and having one end pivotally attached to the support and an opposite end movable toward and away from the support, and a mechanism for moving the shell assembly in response to rotation of the rotatable drum.

8 Claims, 23 Drawing Figures

RUNNING TOY

BACKGROUND OF THE INVENTION

The present invention relates to a running toy movable in a mysterious pattern.

Children's running toys have been proposed in various designs since they are quite popular for their movability. For example, there are known a running toy which moves along a track and another running toy which can move in any direction and then in the opposite direction when it hits an object such as a wall.

These known running toys are primarily designed to achieve their own mobility. However, the pattens of their movement are rather simple and children are likely to be bored soon by the toy's movements.

SUMMARY OF THE INVENTION

It is an object of the present invention to provide a running toy which is movable in a complex movement pattern that is mysterious to the eye and which is of much interest to the user.

According to the present invention, the above object can be achieved by a running toy including a rotatable drum having a cylindical body and axially opposite ends, a driver assembly disposed in the rotatable drum and composed of a drive source, a drive shaft, a gear train operatively disposed between the drive source and the drive shaft for transmitting power from the drive source to the drive shaft, and a reverse mechanism for varying the gear train in meshing combination to change the direction of rotation of the drive shaft, the drive shaft having an end projecting through one of the axially opposite ends of the rotatable drum and supporting a drive gear on the projecting end, a support by which the axially opposite ends are rotatably supported and substantially covering the axially opposite ends, a guide gear fixed to the support and held in mesh with the drive gear for guiding the drive gear to revolve around the guide gear to rotate the rotatable drum in response to rotation of the drive gear, a shell assembly having one end pivotally attached to the support and an opposite end movable toward and away from the support, the shell assembly being shaped to be able to substantially cover the cylindrical body when the opposite end of the shell assembly is positioned closely to the support, and a means for moving the shell assembly in response to rotation of the rotatable drum.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
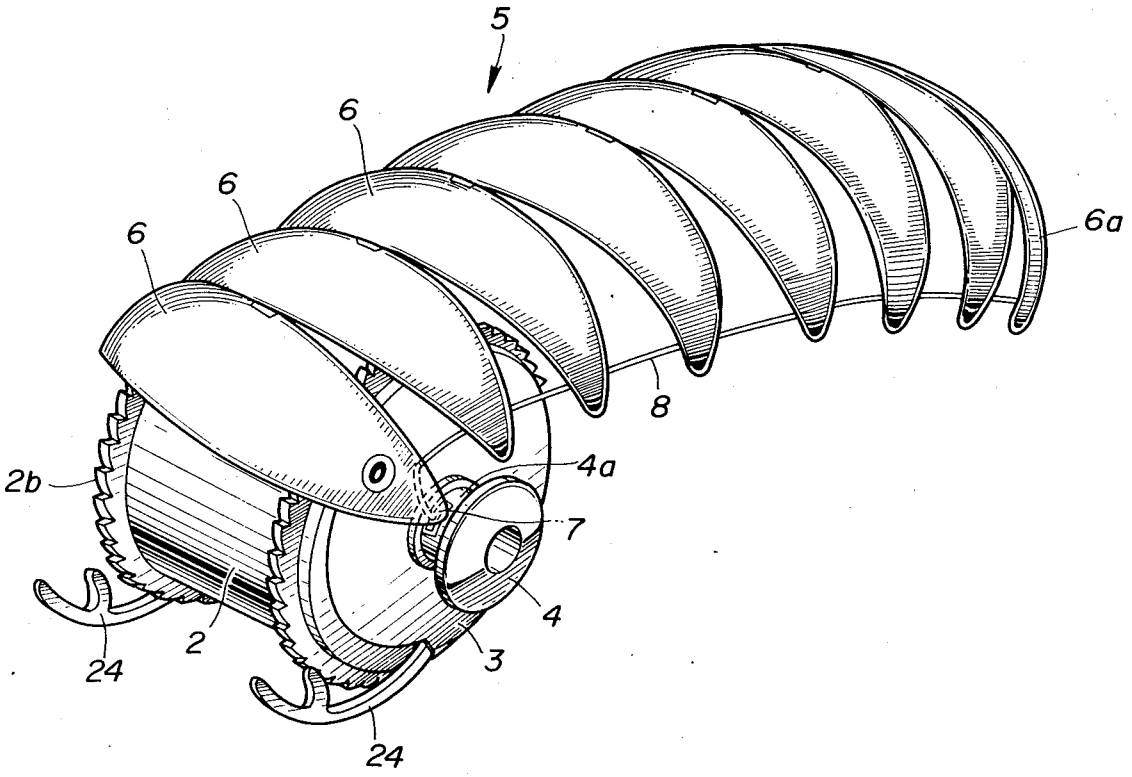
FIG. 1 is a perspective view of a running toy according to a first embodiment of the present invention, showing a shell assembly which is extended.

As shown in FIG. 1, a running toy 1 according to a first embodiment of the present invention is designed in the shape of a green caterpillar. The running toy 1 is generally composed of a rotatable drum 2, a support comprising a pair of support members 3 by which the rotatable drum 2 is rotatably supported, a pair of bobbins 4 mounted respectively on the support members 3 for turning movement with the rotatable drum 2, and a shell assembly 5 attached at one end to the support members 3 and serving as a back of the running toy 1, the shell assembly 5 being contractable into a substantially spherical form.

Figure 2:
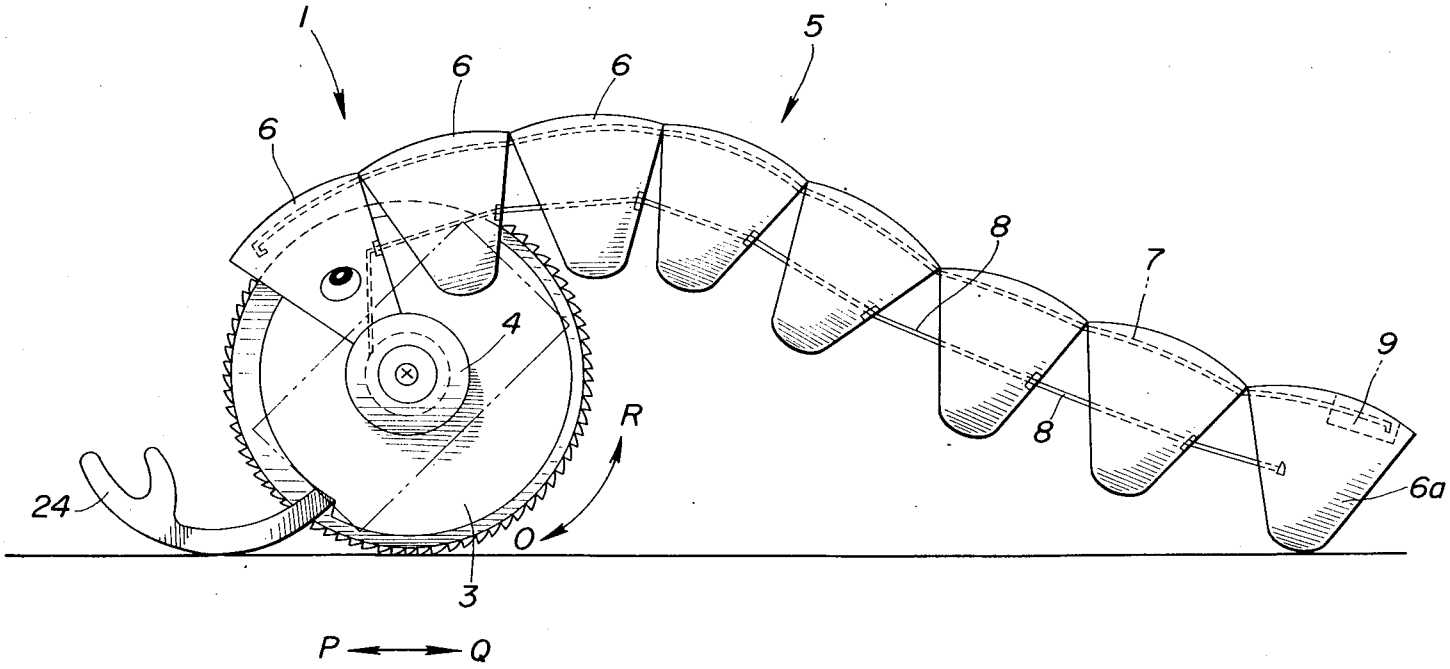
FIG. 2 is a side elevational view of the running toy shown in FIG. 1.

In FIG. 2, the shell assembly 5 comprises a plurality of partly spherical members 6 pivotally coupled together along a leaf spring 7 extending on and across the centers of the reverse concave surfaces of the partly spherical members 6. The partly spherical members 6 include a leading member pivotally mounted on the support members 3. Each of the partly spherical members 6 comprises the partly spherical surface of a spherical segment. The partly spherical members 6 may be formed by cutting off a spherical surface along a plurality of different planes passing through the center of the spherical surface. Strings 8 extend through opposite end portions of each of the partly spherical members 6. One end of each of the strings 8 is tied to the trailing member 6*a* at the distal end of the shell assembly 5, and the opposite end of each string 8 is fixed to one of the bobbins 4. A weight 9 is attached to the reverse concave surface of the distal end member 6a.

Each of the support members 3 is in the shape of a segment formed by cutting off a spherical body along a plane. Each of the bobbins 4 is mounted centrally on one of the support members 3 for turning movement with the rotatable drum 2. The strings 8 can be wound around or unwound from the respective bobbins 4 as the bobbins 4 are rotated. FIGS. 3A through 3F show the manner in which the string 8 is fixed to the corresponding bobbin 4. The bobbin 4 includes a cylindrical body 4a having a recess 72 defined in an outer circumferential surface thereof. A retainer 70 is angularly movably attached by a pin 70a to an inner wall of the recess 72. The retainer 70 has an outer curved surface which is of the same curvature as that of the outer circumferential surface of the cylindrical body 4a. The string 8 has one end fastened to one end of the retainer 70. A stopper 71 projecting from the support member 3 is positioned above the bobbin 4.

Figure 3:
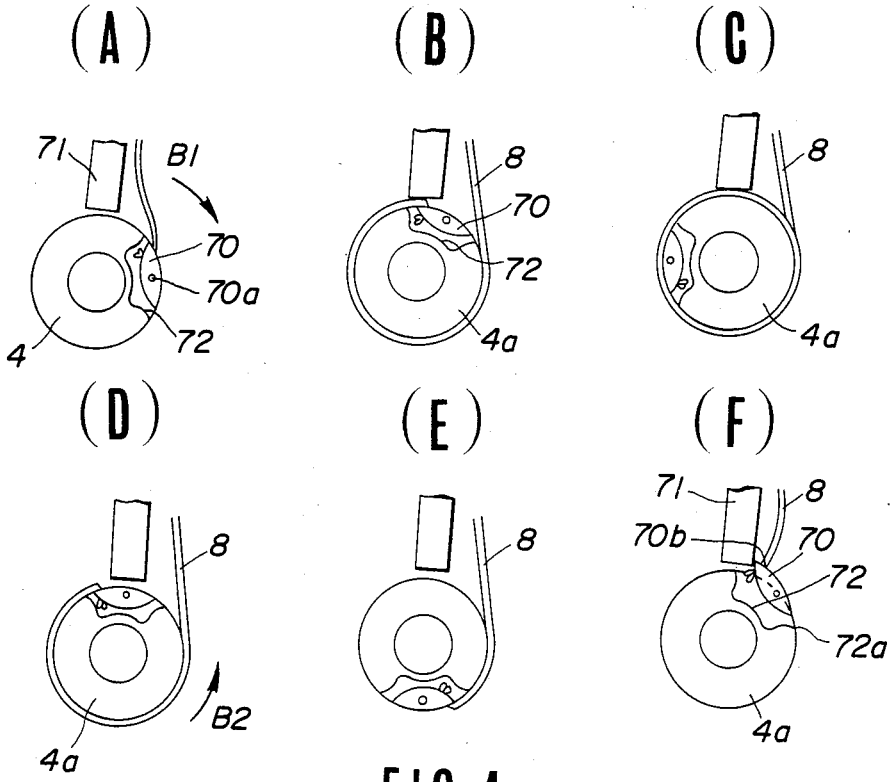
FIGS. 3A through 3F are views showing a bobbin to which a string is attached, FIGS. 3A through 3C illustrating the manner in which the string is wound, FIGS. 3D through 3F showing the manner in which the string is unwound.

When the bobbin 4 is rotated clockwise in the direction of the arrow B1 (FIG. 3A), the string 8 is progressively wound around the bobbin 4 as shown in FIGS. 3A through 3C. Conversely, when the bobbin 4 is rotated counterclockwise in the direction of the arrow B2 (FIG. 3D), the string 8 is progressively unwound from the bobbin 4 as shown in FIGS. 3D through 3F. With the string 8 completely unwound, the retainer 70 is pulled by the string 8 to cause its string-attached end to be lifted into abutment against the stopper 71 as shown in FIG. 3F. Therefore, the bobbin 4 is stopped from further rotation.

Figure 4:
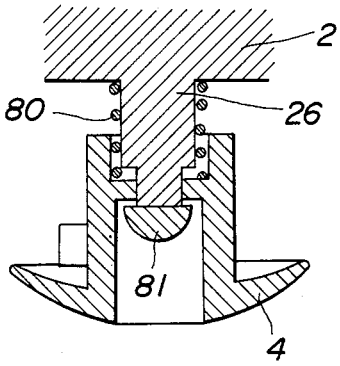
FIG. 4 is a cross-sectional view of the bobbin as attached to a rotatable drum.

As illustrated in FIG. 4, in which the support member 3 is omitted from illustration, the bobbin 4 is resiliently supported on a shaft 26 of the rotatable drum 2 by a coil spring 80 disposed around the shaft 26 for normally urging the bobbin 4 against the head of a screw 81 threaded into the rotatable drum 2. When the bobbin 4 is subjected to external forces larger than the force by which it is resiliently pressed by the spring 80 against the screw head, the bobbin 4 is caused to slide with respect to the rotatable drum 2. Therefore, the bobbin 4 can be prevented by the stopper 71 from rotating counterclockwise beyond the position of FIG. 3F, thus preventing the string 8 from being wound in the direction of the arrow B2.

Figure 5:
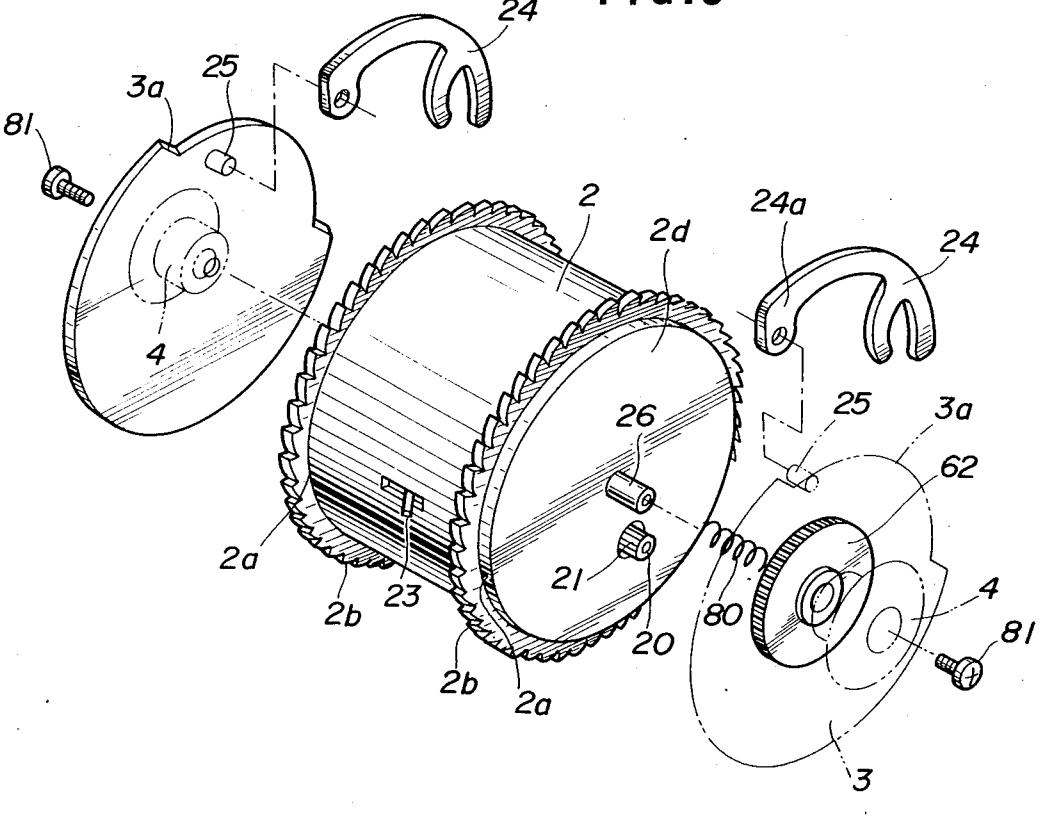
FIG. 5 is an exploded perspective view of support members and the rotatable drum.

As shown in FIG. 5, two rows of teeth 2b are provided on the axially opposite outer circumferential surfaces 2a of the rotatable drum 2, each of the teeth 2b having a more gradual sloping surface in the clockwise direction and a steeper sloping suface in the counterclockwise direction. A driver assembly 29 (FIGS. 6 and 7) is housed in the rotatable drum 2 and includes a drive shaft 20 rotatable selectively in one direction or the other. The drive shaft 20 supports on an end thereof a drive gear 21 projecting from one of the axially opposite side walls of the rotatable drum 2 at an off-center position. The drive gear 21 is held in mesh with a guide gear 62 fixedly mounted on the inner side of one of the support members 3. When the drive shaft 20 rotates in one direction or the other, therefore, the drive gear 21 revolves around the guide gear 62 to rotate the rotatable drum 2 in one direction or the other.

The driver assembly 29 also has a switch lever 23 projecting through a cylindrical surface of the rotatable drum 2. The shaft 26 is disposed centrally on each of the axially opposite side walls. A pair of accessory members 24 designed to look like the feelers of a green caterpillar is pivotally supported at ends 24a on respective pins 25 mounted on the support members 3. The accessory members 24 can therefore be angularly movable about the pins 25 radially outwardly through recesses 3a defined in outer peripheral surfaces of the support members 3.

Figure 6:
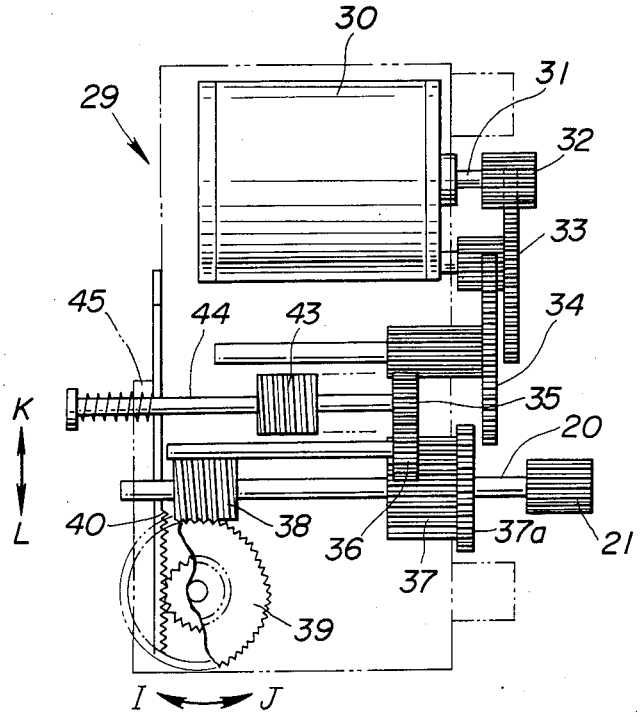
FIG. 6 is a plan view of a driver assembly.
Figure 7:
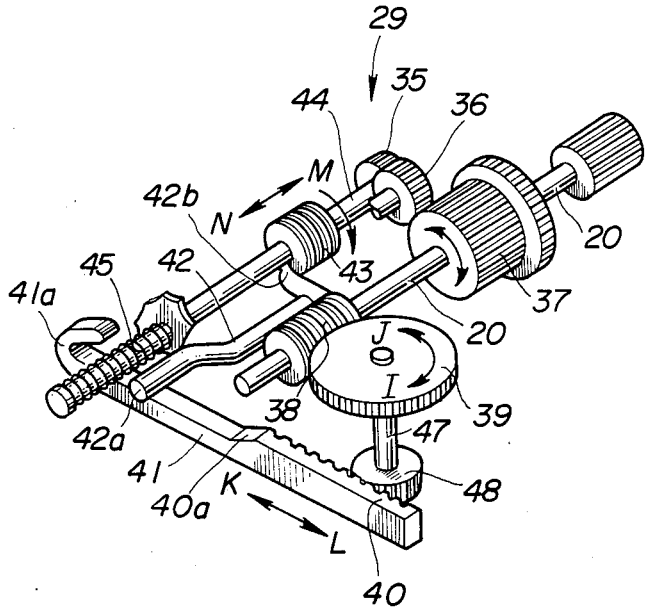
FIG. 7 is a perspective view of the driver assembly.

The driver assembly 29 accommodated in the rotatable drum 2 will be described with reference to FIGS. 6 and 7.

The driver assembly 29 has a motor 30 (FIG. 6) energizable by a battery (not shown) and having an output shaft 31 operatively coupled by a gear 32, speed reducer gears 33, 34, a clutch gear 35, and an idler gear 36 to a drive gear 37 on the drive shaft 20 for rotating the drive shaft 20 in one or normal direction. A first worm gear 38 mounted on the end of the drive shaft 20 remotely from the gear 21 is held in mesh with a gear 39 mounted on one end of a shaft 47 which supports a pinion gear 48 on the other end. The pinion gear 48 meshes with a rack 40 on one end of a reverse starter 41. When the drive shaft 20 is rotated in the normal direction, the gear 39 is rotated by the first worm gear 38 in the direction of the arrow I thereby to move the reverse starter 41 in the direction of the arrow K. The reverse starter 41 has a slanted surface 40a on an end of the rack 40, the slanted surface 40a being inclined downwardly (FIG. 7) in the direction of the arrow K. After the drive shaft 20 has continuously been rotated in the normal direction for a certain period of time, the slanted surface 40a slidingly engages a lateral surface of an outer end 42a of a substantially crank-shaped lever 42. Since the outer end 42a is displaced off-center from the longitudinal axis of the lever 42, the lever 42 is turned about its longitudinal axis. A pointed tooth 42b on the inner end of the lever 42 is thus brought into mesh with a second worm gear 43 on a clutch shaft 44 on which the clutch gear 35 is supported. Therefore, continued rotation of the clutch shaft 44 through the clutch gear 35 causes the clutch shaft 44 to be axially moved in the direction of the arrow M against the resiliency of a coil spring 45 disposed around the clutch shaft 44. When the second worm gear 43 is axially shifted out of mesh with the pointed tooth 42b, the pointed tooth 42b engages the end surface of the second worm gear 43 to prevent the clutch shaft 44 from returning under the force of the coil spring 35. At this time, the clutch gear 35 is axially shifted out of mesh with the idler gear 36 and into a larger-diameter gear 37a on an end of the gear 37 on the drive shaft 20. Therefore, since the idler gear 36 is displaced out of the gear train, the drive shaft 20 is now rotated in the opposite or reverse direction. The first worm gear 38, the gear 39, and the pinion gear 48 are also rotated in the reverse direction to move the rack 40 and hence the reverse starter 41 in the opposite direction of the arrow L. When the reverse starter 41 has moved a certain distance in the direction of the arrow L, an engaging hook 41a on the free end of the reverse starter 41 engages the outer end 42a of the lever 42 to depress the same. The pointed tooth 42b on the lever 42 is now turned radially outwardly out of engagement with the end surface of the second worm gear 43, whereupon the clutch shaft 44 moves back to the original position in the direction of the arrow N under the force of the coil spring 45. The clutch gear 35 then returns into mesh with the idler gear 36 to enable the drive shaft 20 to rotate again in the normal direction. Therefore, the driver assembly 29 has a reverse rotation mechcanism with a gear shifter means, for changing the direction of rotation of the drive shaft 20 in each prescribed interval of time. The driver assembly 29 has its center of gravity displaced a certain distance from the geometric center of the rotatable drum 2.

Operation of the running toy 1 thus constructed will be described below.

When the drive shaft 20 is rotated in the normal direction by the driver assembly 29, the rotatable drum 2 is rotated in the direction of the arrow R (FIG. 2) to move the running toy 1 in the direction of the arrow P. At this time, each of the bobbins 4 is in the angular position of FIG. 3F with the string 8 fully unwound. The bobbins 4 are now idly rotated with respect to the rotatable drum 2, and the shell assembly 5 is extended behind the rotatable drum 2 as shown in FIG. 2. Inasmuch as the center of gravity of the driver assembly 29 and hence the rotatable drum 2 is displaced from the center of the rotatable drum 2, the speed of rotation of the rotatable drum 2 is cyclically varied. Simultaneously, the shell assembly 5 is slightly moved back and forth with respect to the rotatable drum 2 under inertial forces produced by the weight 9. Therefore, the running toy 1 runs in substantially the same pattern as that of the advancing motion of a green caterpillar.

Figure 9:
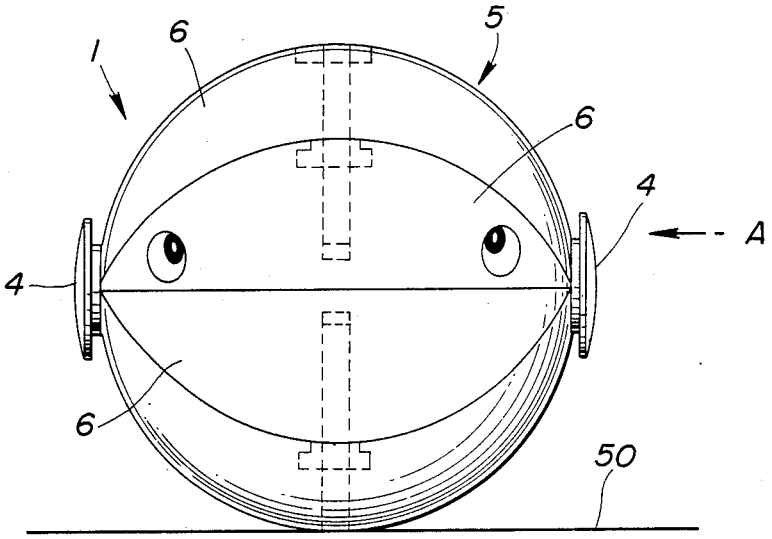
FIG. 9 is a front elevational view of the shell assembly which has been contracted to the spherical shape.
Figure 10:
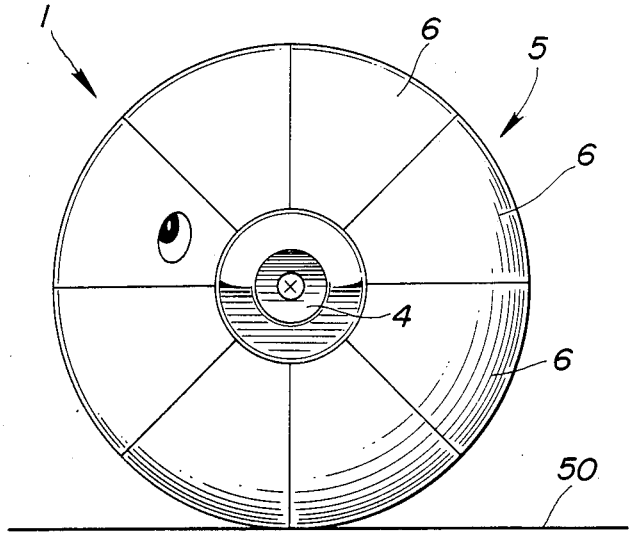
FIG. 10 is a side elevational view taken along line A of FIG. 9.

When the direction of rotation of the drive shaft 20 is reversed by the reverse mechanism of the driver assembly 29, the rotatable drum 2 is then rotated in the opposite direction of the arrow O with the feeler members 24 housed in the support members 3. The bobbins 4 are also rotated in the opposite direction to wind the strings 8 therearound as shown in FIGS. 3A through 3C for thereby causing the shell assembly 5 to be wound or contracted around the rotatable drum 2. As some teeth **2*b* on the rotatable drum 2 engages the rear edge 6*b* of the shell member 6*a*, the drum 2 rides on the reverse side of the rear end of the shell assembly 5, whereupon the running toy 1 is shaped as a substantially spherical form and rolls on a floor 50, as shown in FIGS. 9 and 10. At this time, the bobbins 4 are in the angular position of FIG. 3C and idly rotates with respect to the rotatable drum 2 with the strings 8** completely wound.

Figure 8:
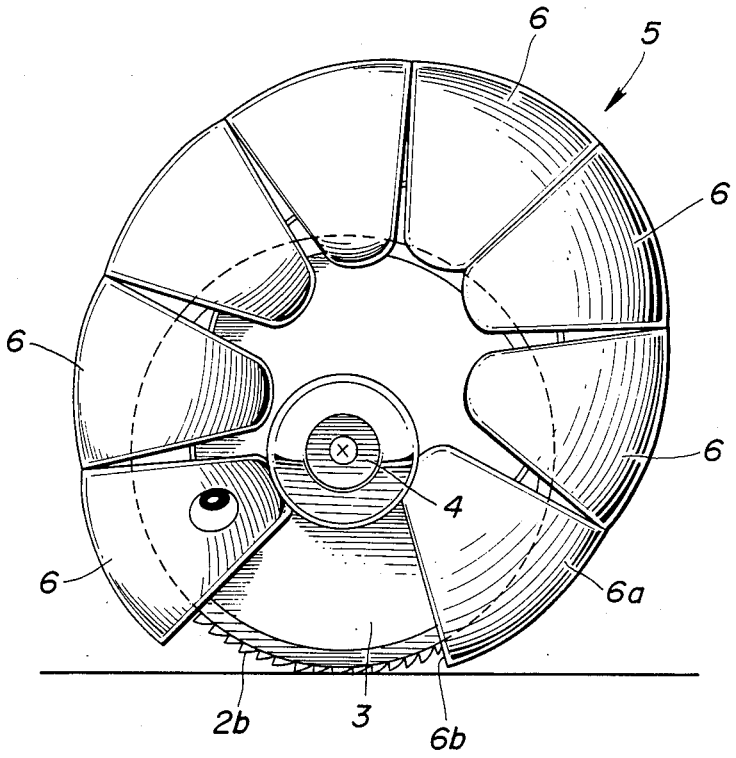
FIG. 8 is a side elevational view showing the manner in which the shell assembly is progressively contracted into a spherical shape.

Upon reversal of the driver assembly 29 again, the rotatable drum 2 and the bobbins 4 are reversed to allow the strings 8 to be unwound as shown in FIGS. 3D through 3F. The shell assembly 5 is now unwound or extended under the resilient force of the leaf spring 7. The running toy 1 is therefore converted from shape of FIGS. 9 and 10 through the shape of FIG. 8 back to the configuration of FIG. 2. This form conversion is immediately possible only when the rotatable drum 2 is positioned below the shell assembly 5. When the rotatable drum 2 is positioned above the shell assembly 5, however, the running toy 1 cannot move since the shell assembly 5 below the rotatable drum 2 is extended. Then, as the direction of rotation of the rotatable drum 2 is reversed again, the running toy 1 is converted to the spherical form again. By repeating the above process, the running toy 1 will finally restore the form as shown in FIGS. 1 and 2 and can run again. The running toy 1 repeats the form conversion each time the direction of rotation of the drum 2 is reversed, thus changing the direction of movement thereof.

As described above, the movement pattern of the running toy 1 of the present invention is unexpected and mysterious to the eye, which is of much interest to the user.

Figure 11:
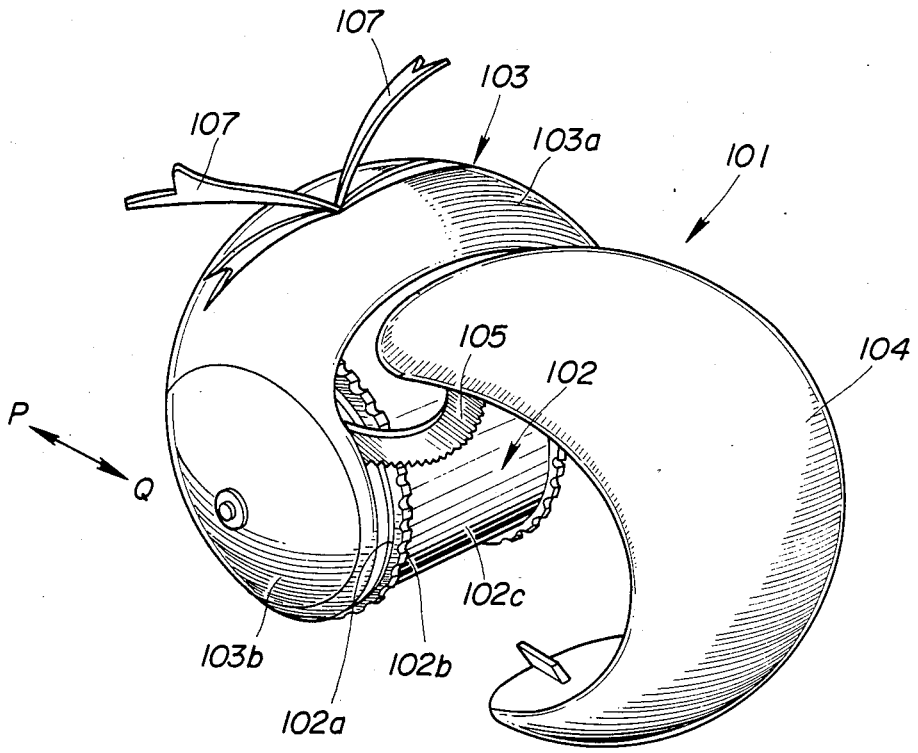
FIG. 11 is a perspective view of a running toy according to a second embodiment, with a shell assembly open.

FIGS. 11 through 18 illustrate a running toy according to a second embodiment of the present invention. Like the first embodiment, the running toy resembles a green caterpillar. As illustrated in FIG. 11, the running toy, generally designated at 101, generally comprises a rotatable drum 102, a substantially spherical support 103 in which the rotatable durm 102 is rotatably supported, a shell assembly 104 pivotally mounted on the support 103 and capable of coaction therewith for forming a complete spherical shape, and an elongate swing member 105 for swinging the shell assembly 104 in response to rotation of the rotatable drum 102.

Figure 12:
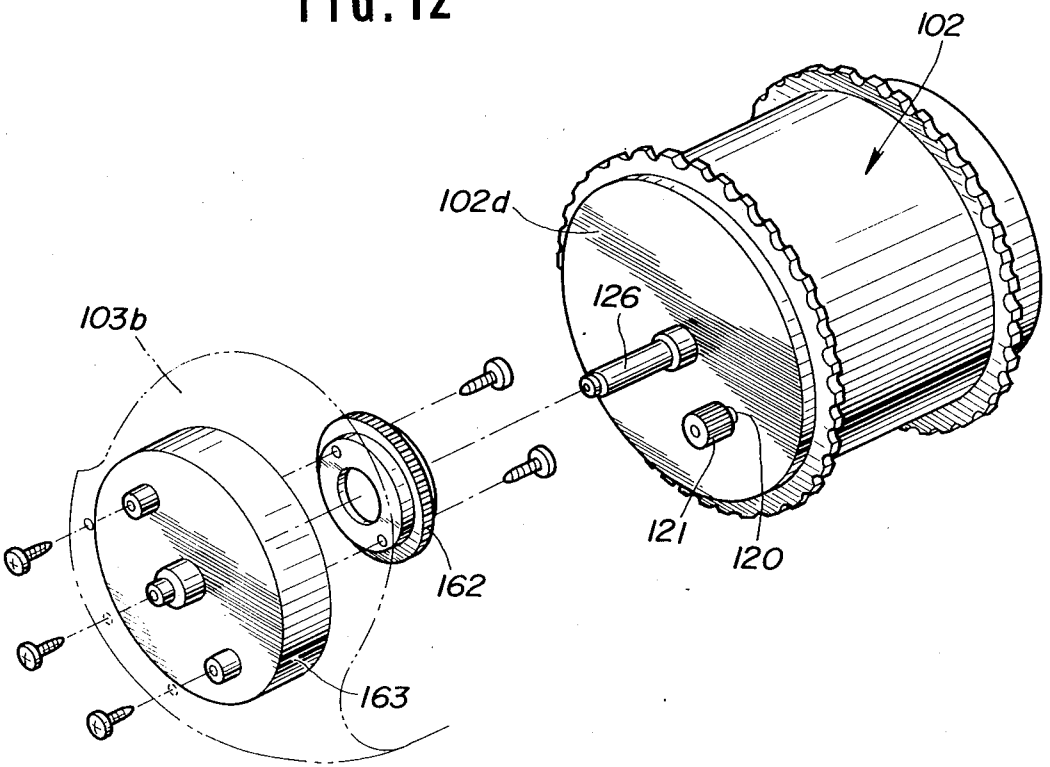
FIG. 12 is an exploded perspective view of a support member and a rotatable drum of the running toy illustrated in FIG. 11, the view showing one end of the rotatable drum.

The rotatable drum 102 has a cylindrical body **102*c* having two rows of teeth 102*b* extending entirely around axially opposite outer circumferential surfaces 102*a*, respectively. The rotatable drum 102 also has a pair of axially opposite side walls 102*d*, 102*e* on which the confronting portions 103*b* of the support 103 are rotatably supported. As shown in FIG. 12, a driver assembly (described later on) housed in the rotatable drum 102 includes a drive shaft 120 having one end projecting from one of the side walls 102*d* at an off-center position, the projecting end of the drive shaft 120 supporting a drive gear 121. The drive gear 121 is held in mesh with a gear 162 serving as a guide member and fixed by an attachment 163 to the inner surface of the portion 103*b* of the support 103 confronting the drive gear 121. The rotatable drum 102 can therefore be rotated in one direction or the other when the drive gear 121 meshing with the gear 162 is rotated. A shaft 126 is disposed centrally on each of the side walls 102*d*, *102e* of the rotatable drum 102 and rotatably suported on the attachment 163**.

Figure 13:
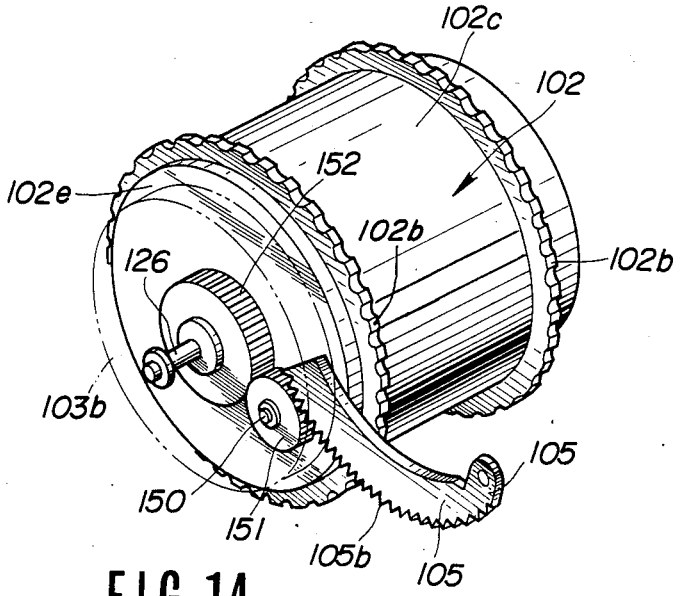
FIG. 13 is a perspective view of the rotatable drum, showing the other end of the rotatable drum.
Figure 14:
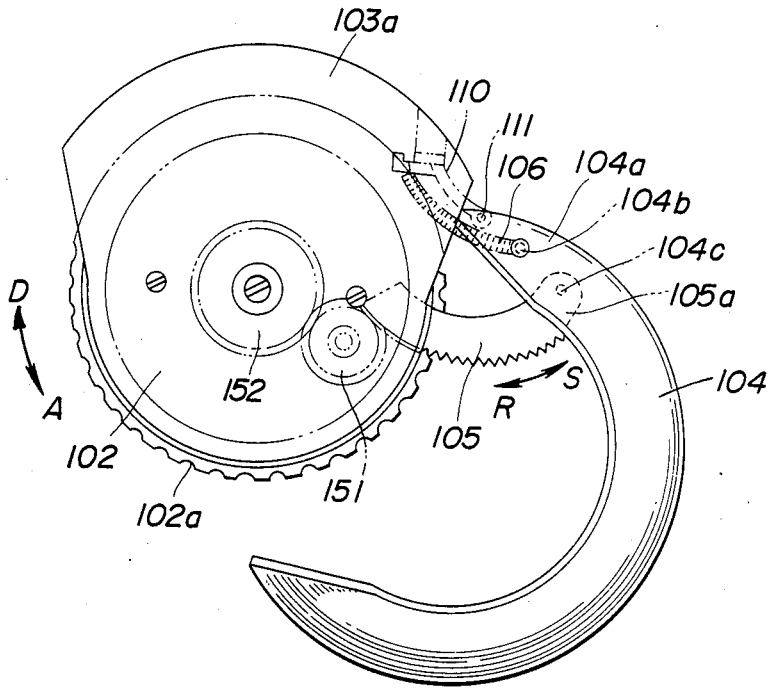
FIG. 14 is a side elevational view of a shell assembly as it is open, showing the other end of the rotatable drum.

As shown in FIG. 13, a gear 152 is centrally attached to the other side wall **102*e* and mounted on the shaft 126. The gear 152 is held in mesh with a gear 151 rotatably supported by a shaft 150 on the portion 103*b* of the support 103 confronting the gear 152. In FIG. 14, the shell assembly 104 extends along the cylindrical body 102*c* of the rotatable drum 102 and cooperates with the support 103 in forming the spherical form. An end 104*a* of the shell assembly 104 is pivotally supported by a pin 111 on a connector 110 fastened to the support 103 and is normally urged in the direction to be closed over the drum 102 by a coil spring 106 extending between the support 103 and a portion 104*b* of the shell assembly 104. The swing member 105 comprises an arcuate toothed member having an end 105*a* pivotally coupled by a pin 104*c* integral with the shell assembly 104 to the shell assembly 104 slightly behind the portion 104*b* thereof. The arcuate toothed member 105 has a row of teeth 105*b* defined along a longitudinal edge thereof and held in mesh with the gear 151**.

Figure 15:
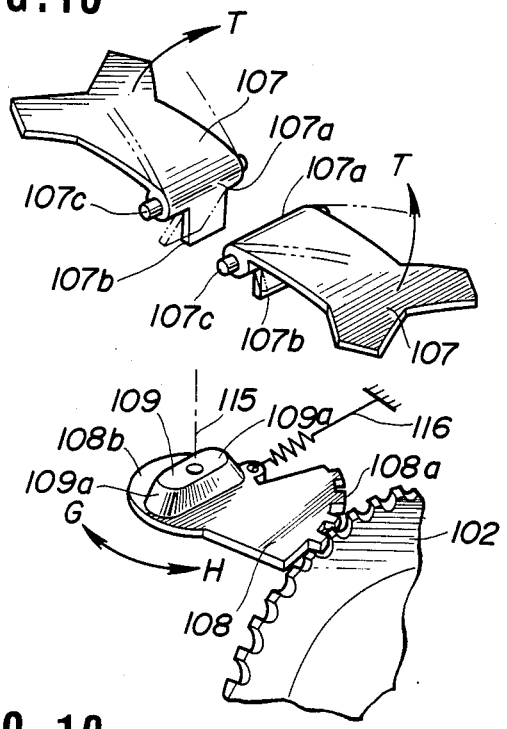
FIG. 15 is a fragmentary perspective view of feeler members.

FIG. 15 shows a pair of feeler members 107 shaped like those of a green caterpillar. The feeler members 107 are pivotally supported at ends **107*a* theref on the support 103 by means of shafts 107*c*, respectively. A feeler swinging member 108 supported on the support 103 has an end 108*b* angularly movable about an axis 115 and is normally urged by a spring 116 to turn in one direction. The feeler swinging member 108 is in the form of a substantially sectorial plate having teeth 108*a* which are movable into or out of engagement with the teeth 102*b* on the drum 102 for turning the feeler swinging member 108 about the axis 115 in the direction of the arrow G or H. The end 108*b* of the feeler swinging member 108 has an oblong projection 109 having opposite ends 109*a*. When the feeler swinging member 108 is angularly moved about the axis 115, the ends 109*a* of the projection 109 engage tongues 107*b* of the ends 107*a* of the feeler members 107 for swinging the feeler members 107** in the directions of the arrows T.

Figure 16:
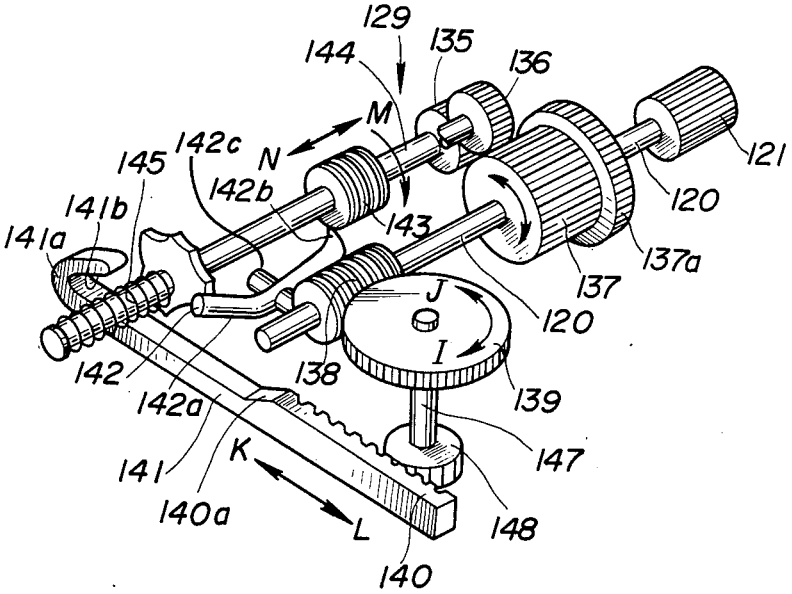
FIG. 16 is a view similar to FIG. 6, showing a driver assembly according to the second embodiment.

The driver assembly accommodated in the rotatable housing 102 will be described with reference to FIG. 16.

The driver assembly, generally denoted at 129, includes a reverse mechanism for rotating the rotatable drum 2 in one direction or the other. The rotative output from a motor (not shown) is transmitted through an output gear (not shown) and speed reducer gears (not shown), as with the first embodiment, and thence through a clutch gear 135 and an idler gear 136 to a drive gear 137 on the drive shaft 120 for rotating the drive shaft 120 in one or normal direction. At this time, a first worm gear 138 mounted on the drive shaft 120 remotely from the drive gear 121 rotates a gear 139 in the direction of the arrow J to cause a pinion gear 148 coupled by a shaft 147 to the gear 139 to move a rack 140 in mesh therewith in the direction of the arrow L. A reverse starter 141 having the rack 140 on one end thereof is therefore moved in the direction of the arrow L. An engaging hook 141*a* on the opposite end of the reverse starter 141 then engages an outer end 142*a* of a lever 142 which is pivotally supported on a shaft 142*c* extending transversely of the longitudinal axis of the lever 142. The outer end 142*a* of the lever 142 is now depressed by and along a slanted surface 141*b* of the engaging hook 141*a*, whereupon a pointed tooth 142*b* on the inner end of the lever 142 is elevated into mesh with a second worm gear 143 mounted on a clutch shaft 144 which supports the clutch gear 135. As the clutch shaft 144 rotates continuously, the second worm gear 143 meshing with the pointed tooth 142*b* moves the clutch shaft 144 axially in the direction of the arrow M against the resiliency of a coil spring 145 coiled around the clutch shaft 144. When the pointed tooth 142*b* is brought out of mesh with the second worm gear 143, the pointed tooth 142*b* engages an end surface 143*a* of the second worm gear 143 to prevent the clutch shaft 144 from returning under the force of the coil spring 145. At this time, the clutch gear 135 on the clutch shaft 144 is shifting out of mesh with the idler gear 136 and into mesh with a larger-diameter gear 137*a* on the drive shaft 120 at one end of the gear 137, thereby rotating the drive shaft 120 in the opposite or reverse direction. The first worm gear 138, the gear 139, and the pinion gear 148 are also reversed in their rotation to move the reverse starter 141 in the direction of the arrow K. The reverse starter 141 has a slanted surface 140*a* on one end of the rack 140, the slanted surface 140*a* being inclined downwardly in the direction of the arrow K. As the reverse starter 141 is moved in the direction of the arrow K as described above, the slanted surface 140*a* engages the outer end 142*a* of the lever 142 to raise the outer end 142*a* along the slanted surface 140*a*. The lever 142 is turned about the shaft 142*c* to displace the pointed tooth 142*b* radially outwardly out of engagement with the end surface 143*a* of the second worm gear 143, whereupon the clutch shaft 144 returns to the original position in the direction of the arrow N under the force of the coil spring 145. The clutch gear 135 now meshes with the idler gear 136 to rotate the drive shaft 120 in the normal direction.

The running toy 101 of the second embodiment will operate as follows:

When the drive shaft 120 is rotated in the normal direction by the driver assembly 129, the rotatable drum 102 is rotated in the direction of the arrow A in FIG. 14 to move the running toy 101 in the direction of the arrow P in FIG. 11.

At this time, the swing member 105 is in the position of FIGS. 11, 13 and 14 with the shell assembly 104 fully opened from the rotatable drum 102. The feeler members 107 are now turned in the directions of the arrows T until they project obliquely upwardly from the support 103 in response to the angular movement of the member 108 in the direction of the arrow G. The center of gravity of the rotatable drum 102 is displaced from the geometric center thereof, thus cyclically varying the speed of rotation of the drum 102. Therefore, the running toy 101 moves in a pattern resembling that of a green caterpillar.

Figure 17:
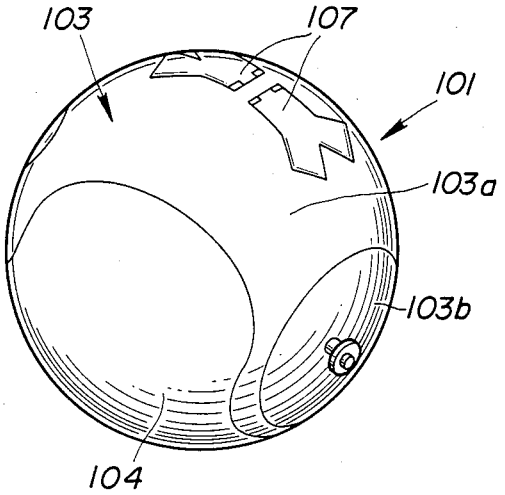
FIG. 17 is a perspective view of the running toy of the second embodiment, showing the shell assembly as closed.

When the direction of rotation of the drive shaft 120 is reversed by the reverse mechanism of the driver assembly 129, the rotatable drum 102 is then rotated in the direction of the arrow D (FIG. 14) with the feeler members 107 retracted in the support 103. The running toy 101 is now moved back in the direction of the arrow Q (FIG. 11). The swing member 105 is moved in the direction of the arrow R (FIG. 14) in response to rotation of the gear 151, thus causing the shell member 104 to swing about its pivoted end until it moves through the position of FIG. 18 and covers the rotatable drum 102 as shown in FIG. 17. The support 103 and the shell assembly 104 now cooperate with each other in making the running toy 101 completely spherical in appearance.

Figure 18:
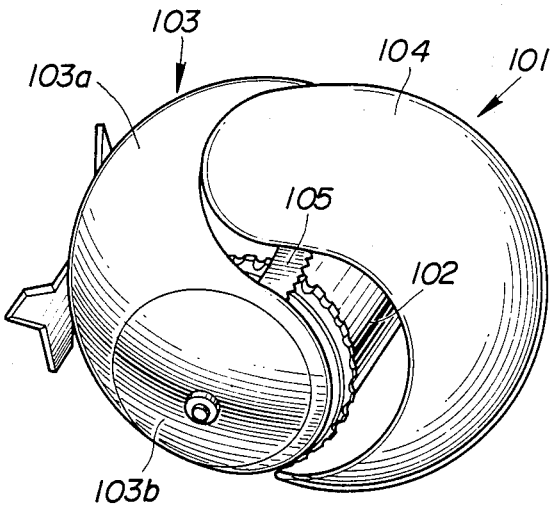
FIG. 18 is a perspective view of the running toy of the second embodiment, with the shell assembly being in the process of being opened or closed, the running toy being shown in an angular position which is 90° spaced from the angular position of FIG. 17.

As the driver assembly 129 is reversed again, the rotatable drum 102 is also reversed to convert the running toy 101 from the form of FIG. 18 back to the form of FIG. 11. As with the first embodiment, this form conversion is possible only when the rotatable drum 102 is positioned below the shell assembly 104. When the rotatable drum 102 is positioned above the shell assembly 104, however, the running toy 101 cannot move since the shell assembly 104 below the rotatable drum 102 is opened away from the drum 102. Then, as the direction of rotation of the rotatable drum 102 is reversed again, the running toy 1 is converted to the spherical form again as shown in FIG. 17. By repeating the above process, the running toy 101 will eventually restore the form as shown in FIG. 11 and can run again. The running toy 101 repeats the form conversion each time the direction of rotation of the drum 102 is reversed, thus changing the direction of movement thereof.

In the first and second embodiments described above, the direction of rotation of the drive shaft is reversed cyclically in each period of time through different gear combinations. However, the direction of rotation of the drive shaft may be reversed by moving the lever 42 or 142 in response to engagement of the feeler members 24 or 107 with an object such as an obstacle positioned in the way of the running toy 1 or 101.

Although certain preferred embodiments have been shown and described, it should be understood that many changes and modifications may be made therein without departing from the scope of the appended claims.

I claim:

1. A running toy comprising:

a rotatable drum having a cylindical body and axially opposite ends;

a driver assembly disposed in said rotatable drum and composed of a drive source, a drive shaft, a gear train operatively disposed between said drive source and said drive shaft for transmitting power from said drive source to said drive shaft, and a reverse mechanism for varying the gear train in meshing combination to change the direction of rotation of said drive shaft;

said drive shaft having an end projecting through one of said axially opposite ends of said rotatable drum and supporting a drive gear on the projecting end;

a support by which said axially opposite ends are rotatably supported and substantially covering said axially opposite ends;

a guide gear fixed to said support and held in mesh with said drive gear for guiding the drive gear to revolve around the guide gear to rotate said rotatable drum in response to rotation of said drive gear;

a shell assembly having one end pivotally attached to said support and an opposite end movable toward and away from said support, said shell assembly being shaped to be able to substantially cover said cylindrical body when said opposite end of the shell assembly is positioned closely to said support; and means for moving said shell assembly in response to rotation of said rotatable drum.

2. A running toy according to claim 1, wherein said shell assembly comprises a plurality of partly spherical members each comprising the partly spherical surface of a spherical segment, said partly spherical members including leading and trailing partly spherical members, said leading partly spherical member being pivotally mounted on said support.

3. A running toy according to claim 2, wherein said shell assembly includes a leaf spring extending on and across the reverse concave surfaces of said partly spherical members between said leading and trailing partly spherical members.

4. A running toy according to claim 2, wherein said means includes a pair of bobbins mounted respectively on said axially opposite ends of the rotatable drum for rotation with said rotatable drum, and a pair of strings extending through said partly spherical members and having ends fixed to said trailing partly spherical member, said strings having opposite ends fixed to said bobbins, respectively, whereby said strings can be wound around said bobbins, respectively, in response to rotation of said rotatable drum.

5. A running toy according to claim 1, wherein said shell assembly comprises a single partly spherical member.

6. A running toy according to claim 5, including a resilient member acting between said shell assembly and said support for normally urging said shell assembly to move toward said support.

7. A running toy according to claim 5, wherein said means comprises a gear assembly rotatable in response to rotation of said rotatable drum, and an elongate member having an end pivotally supported on said shell assembly and a row of teeth defined along a longitudinal edge thereof and meshing with said gear assembly for swinging said shell assembly in response to rotation of said gear assembly.

8. A running toy according to claim 7, wherein said gear assembly comprises a first gear mounted on said rotatable drum for rotation therewith and a second gear supported on said support and held in mesh with said first gear for being rotated thereby, said teeth of said elongate member being held in mesh with said second gear.

* * * * *